US006644149B2

(12) United States Patent
Giannakakos et al.

(10) Patent No.: US 6,644,149 B2
(45) Date of Patent: Nov. 11, 2003

(54) EXTRACTION TOOL FOR TANGED HELICALLY COILED INSERTS WITH IMPROVED REMOVABILITY

(75) Inventors: William Giannakakos, Danbury, CT (US); William Lutkus, Watertown, CT (US); J. Peter Ferreira, Danbury, CT (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 09/955,513

(22) Filed: Sep. 17, 2001

(65) Prior Publication Data

US 2003/0051584 A1 Mar. 20, 2003

(51) Int. Cl.[7] ..... B25B 13/48

(52) U.S. Cl. ..... 81/436; 81/442; 81/448; 81/53.2; 29/227

(58) Field of Search ..... 81/436, 442, 448, 81/449, 53.2; 29/227, 229, 240.5

(56) References Cited

U.S. PATENT DOCUMENTS

| | | | | |
|---|---|---|---|---|
| 133,536 A | * | 12/1872 | Johnson | 81/442 |
| 2,390,545 A | | 12/1945 | Lang | |
| 2,586,805 A | | 2/1952 | Forster | |
| 2,594,901 A | | 4/1952 | Forster | |
| 3,111,751 A | | 11/1963 | Eddy | |
| 4,172,314 A | | 10/1979 | Berecz et al. | |
| 4,553,302 A | | 11/1985 | Cosenza et al. | |
| 4,553,303 A | | 11/1985 | Yamamoto | |
| 4,980,959 A | | 1/1991 | Czarnowski | |
| 5,214,831 A | | 6/1993 | Collins, Jr. et al. | |
| 5,309,617 A | | 5/1994 | Dannar | |
| 5,456,145 A | | 10/1995 | Cosenza | |

* cited by examiner

*Primary Examiner*—D. S. Meislin
(74) *Attorney, Agent, or Firm*—Harness, Dickey & Pierce, P.L.C.

(57) ABSTRACT

An apparatus for removing helical thread inserts having a removal notch formed along a female thread surface. The apparatus can selectively extract helical thread inserts by selectively engaging the removal notch and actuating the end of the insert radially inward to prevent the end of the insert from engaging threads of the bore which it is disposed in. The apparatus includes a handle, a head attached to the handle, and a manually operable key. The head includes a bore formed therethrough having a central axis offset from central axis of the head, whereby the key is rotatably supported in the bore and includes an engaging lip for selectively engaging the removal notch of the insert and allowing for easier removal of the insert.

12 Claims, 6 Drawing Sheets

EXTRACTION TOOL FOR TANGED HELICALLY COILED INSERTS WITH IMPROVED REMOVABILITY

FIELD OF THE INVENTION

The present invention relates to a tool for removing thread inserts. More specifically, the present invention relates to a hand tool having an offset key located therein to selectively engage a removal notch on a helical thread insert for removing the helical thread insert from a threaded bore within a parent material.

BACKGROUND OF THE INVENTION

Helical thread inserts are used in many industries to provide female threads in a threaded bore located in a parent material having a relatively low hardness. The helical thread inserts are installed using a special tool that grasps a removable tang located at the leading end of the helical thread insert and guides the insert into the threaded bore in the parent material. The tang is then removed to provide a threaded bore having female threads with a greater hardness than the female threads formed in the original threaded bore. In the event that the helical thread inserts become worn or damaged, removal of the thread insert may be required.

In recognition of the need to remove helical thread inserts several devices have been developed. Some helical thread inserts include a pair of diametrically opposed notches formed in the last thread of the insert. The notches allow a flathead screwdriver or other tool to apply a counterclockwise torque to guide the insert out of the original threaded bore. However, the use of a flathead screwdriver or other tool may apply forces that drive the insert back into the threaded bore or expand the last thread of the insert radially outward. If the tool applies a force on the insert that pushes the insert back into the original threaded bore, removal of the thread insert is made more difficult because the desired direction of movement of the insert, out of the hole, is opposite of the force that is applied on the insert. Additionally, if the tool causes expansion of the last thread of the insert, the end of the thread may dig into the parent material causing removal of the thread insert to be more difficult and possibly damaging the parent material. In recognition, thread inserts have been developed that have chamfered and radiused edges formed around the end of the last thread to prevent the thread from digging into the parent material.

However, one concern associated with helical thread inserts is retention capability, the ability of the insert to remain in the threaded bore. The use of chamfered or radiused ends reduces the ability of the end of the thread insert to grasp the parent material to prevent counterclockwise movement, leading to inadvertent removal of the insert. Additionally, the increasing popularity of stainless steel helical thread inserts in combination with stainless steel threaded fasteners may lead to galling. If galling occurs, the forces applied to the threaded fastener are directly transferred to the helical thread insert, thus increasing the likelihood that the helical thread insert will not remain in the threaded bore.

SUMMARY OF THE INVENTION

Accordingly, the present invention provides an apparatus for removing helical thread inserts having a removal notch formed in the last thread. The apparatus selectively engages the removal notch on the helical thread insert and actuates the end of the thread insert radially inward away from the parent material, thereby eliminating the contact between the end of the thread insert and the parent material.

The apparatus is generally comprised of a sleeve, a head and a key. The head includes an offset bore disposed therethrough. The key, which is manually actuable between an engaging position and a neutral position is located within the bore of the head and contains an engaging face that selectively engages the removal notch of the helical thread insert in order to actuate the end portion of the insert radially inward.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
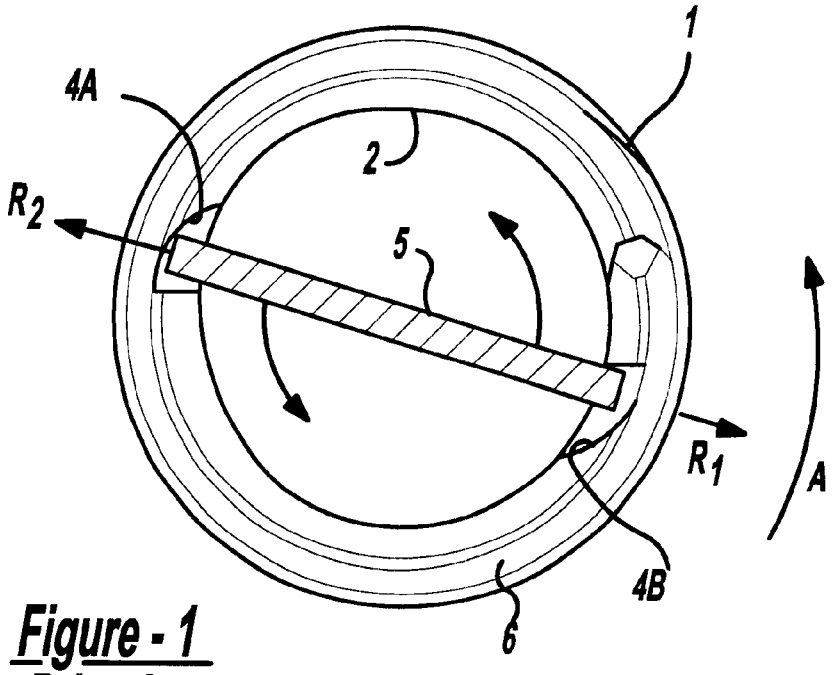
Figure - 1 Prior Art
FIG. 1 is an top view of a helical thread insert having a removal tool engaged thereto.
Figure 2:
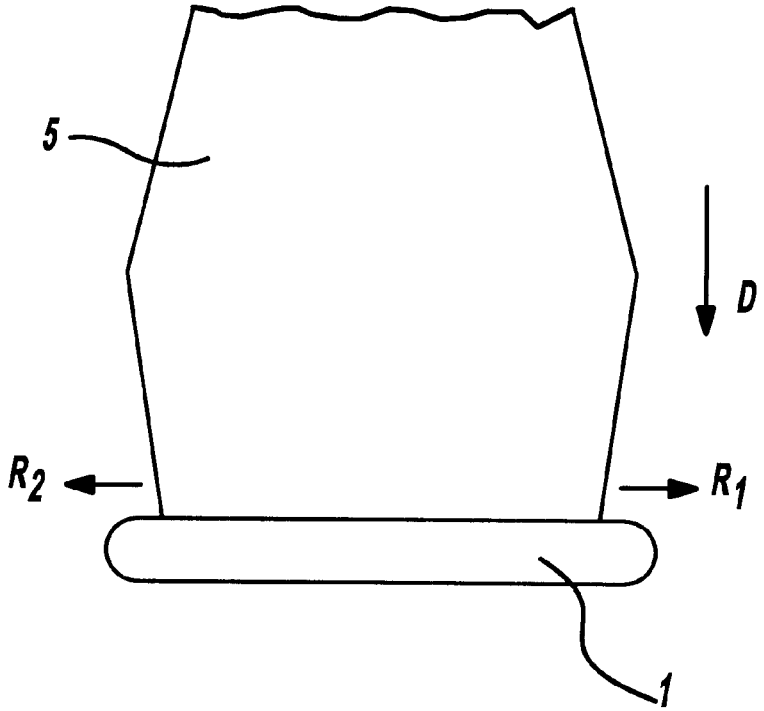
Figure - 2 Prior Art
FIG. 2 is a side view of the helical thread insert and removal tool of FIG. 1.

FIGS. 1 and 2 illustrate a helical thread insert 1 having a prior art extraction tool 5 shown in operative engagement. To extract the helical thread insert from a threaded bore in a parent material, a counterclockwise torque is applied in the direction of arrow A. However, in applying a torque in direction A, a downward force D and radial forces R1 and R2 may also be applied. Force D is applied by the operator of extraction tool 5 to engage the end of the extraction tool 5 in the notches 4A and 4B of coil 1. The direction of force D is opposite to the direction that the helical thread insert 1 is desirably traveling, out of the threaded bore. Forces R1 and R2 are generated if extraction tool 5 has a tapered engaging side similar to a flathead screwdriver as shown on extraction tool 5 of FIG. 2. Forces R1 and R2 may expand the last thread of the helical thread insert 1 radially outward, engaging the female threads of the softer parent material and making removal more difficult.

Figure 3:
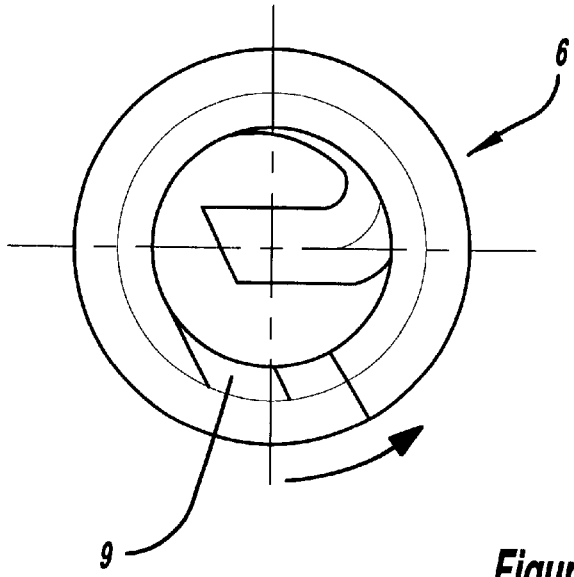
FIG. 3 is an end view of a helical thread insert.

FIG. 3 illustrates a helical thread insert 6, for which there is a copending application filed on the same date and owned by the same assignee. Helical thread insert 6 includes a single removal notch 9 located near the end of the last thread of the helical thread insert 6. With continued reference to helical thread inserts, the helical thread insert 6 shown in FIG. 3 will be used for further reference. However, it is understood that the present invention may be used to remove a helical thread insert similar to the type shown in FIG. 1, FIG. 3 or any type having a removal notch located on the inside surface of the thread that is engageable by the present invention.

Figure 4:
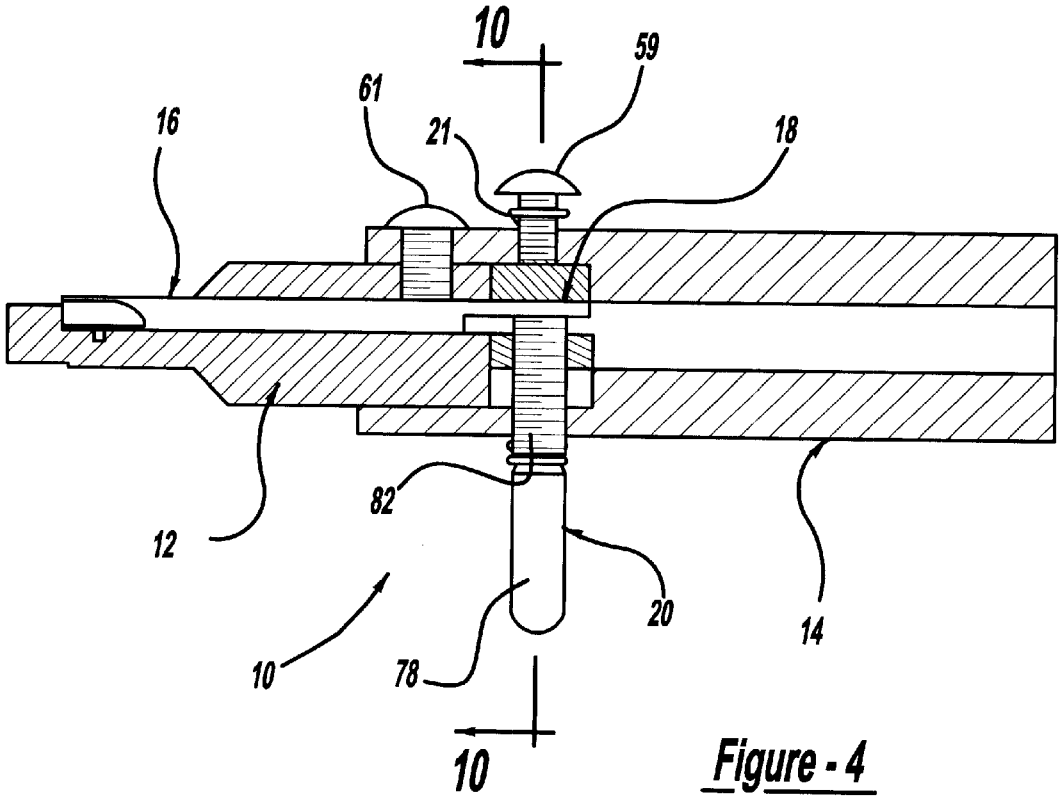
FIG. 4 is a plan view of a helical thread removal tool according to the preferred embodiment with part of a housing removed to show the internal workings of the removal tool.

As shown in FIG. 4, a selection view of extraction tool 10 illustrates the parts comprising an extraction tool according to the present invention. Extraction tool 10 is generally composed of a sleeve 14 connected to a head 12 having a key 16 disposed in a non-co centric bore disposed therethrough that is operatively rotated by a collar 18 which is manually actuable by a handle 20.

Figure 5:
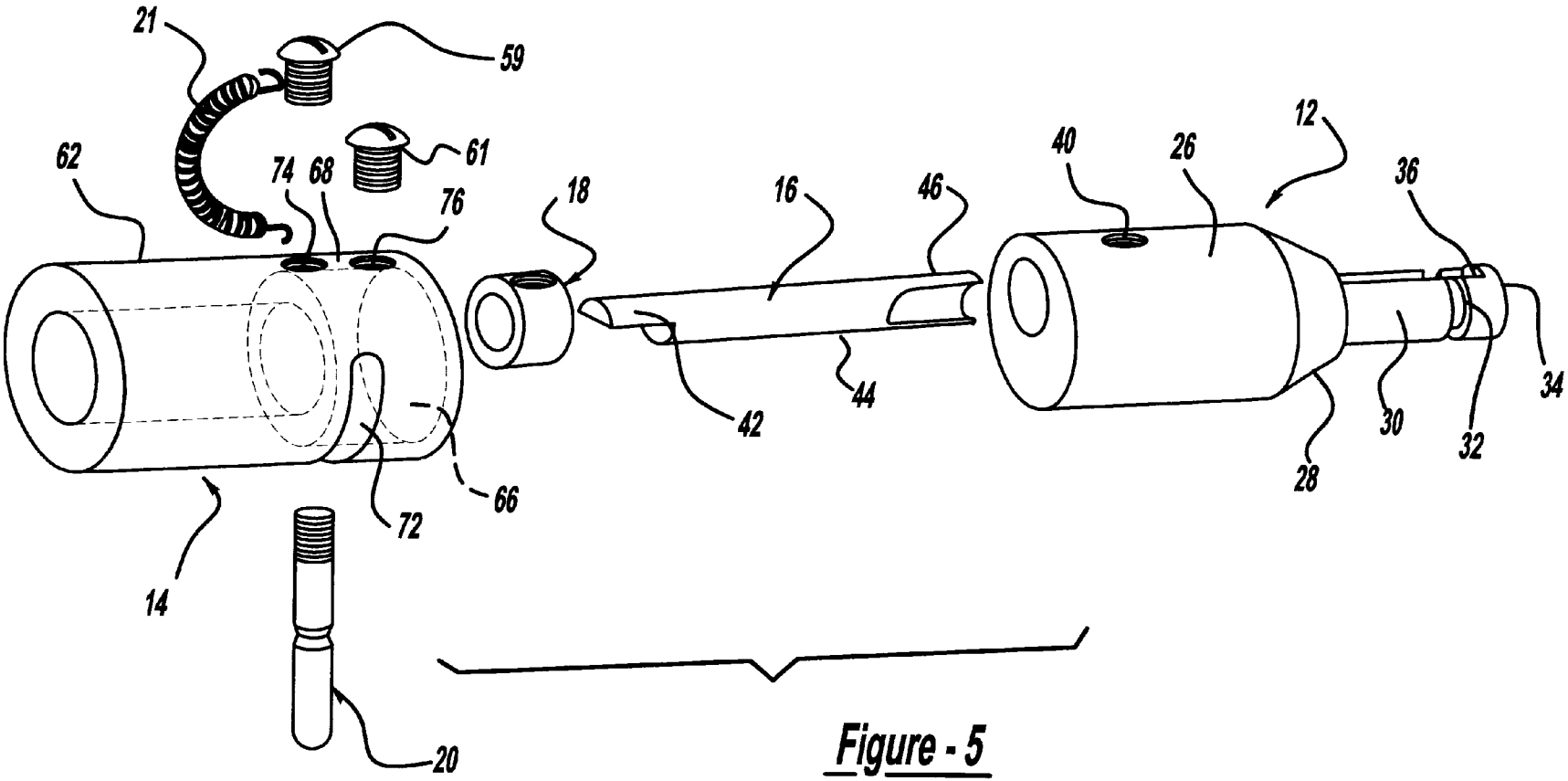
FIG. 5 is an exploded view of the removal tool of FIG. 4.

Head 12 of extraction tool 10 is shown in FIG. 5 to include a body portion 26 and a neck 30 interconnected by a bevel portion 28. Body portion 26 is formed in a cylindrical shape having a circular cross section for operatively receiving sleeve 14. However, body portion 26 may be constructed in alternative shapes that may be used to receive sleeve 14 or another member similar to sleeve 14. A threaded hole 40 is formed near the rear of head 12 to selectively secure head 12 to sleeve 14. Neck 30, which is connected to body portion 26 through a bevel portion 28 is constructed in a cylindrical shape having a circular cross section that is larger than a minor diameter of helical thread insert 6. Extending through body portion 26, bevel portion 28 and neck 30 is a circular bore 38. Bore 38 is formed offset, not concentric, with body portion 26 or neck 30. In a preferred embodiment, bore 38 is formed having a diameter that is substantially similar to the distance from the centerline of the helical thread insert 6 to the removal notch 9 located on the last thread of the helical thread insert 6. Additionally, bore 38 is preferably constructed so that the centerline of neck 30 is tangent to the outer edge of bore 38. Extending from the distal end of neck 30 is an undercut portion 36, through which bore 38 extends, having a diameter that is smaller than the minor diameter of the thread insert. Attached to the end of undercut portion 36 is a pilot journal 32, having an outer diameter 34 that is substantially similar to the minor diameter of helical thread insert 6.

Sleeve 14 is shown in FIG. 5 to be composed of a body portion 62 for manipulating extraction tool 10 and a casing 68 that contains the mechanism of the extraction tool 10. Body portion 62 is preferably formed in a cylindrical shape having a diameter suitable for grasping by a person. Attached to the end of body portion 62 is casing 68. Casing 68 is generally defined by a cylinder having a bore 66 disposed therein. Located near the bottom of bore 66 is a slot 72 that extends radially along the casing 68 for a span of 55 degrees for receiving handle 20 which will be discussed in greater detail later. Additionally, a pair of threaded holes 74 and 76 are positioned along casing 68 to selectively secure head 12 and retain a spring element 21 which is positioned along the outer surface of the casing and biases handle 20 with respect to sleeve 14.

Figure 6:
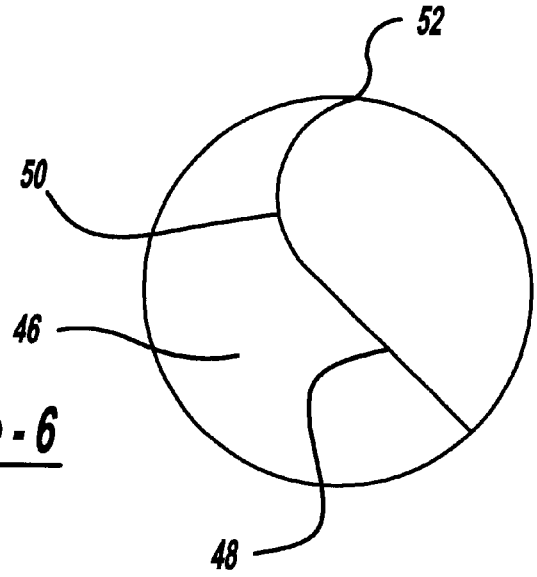
FIG. 6 is an end view of a key in accordance with the principles of the present invention.

Key 16 shown in FIGS. 5 and 6 to be composed of an elongated member having a notch 42 at one end for attaching key 16 to collar 18, a main body 44 for transferring rotational movement from collar 18 and a cam 46 for engaging removal notch 9 located in the helical thread insert 6. In a preferred embodiment, notch 42 is formed to have a cross section that is semicircular on shape to allow for engagement by collar 18. Main body 44 is formed to have a circular cross section that is substantially similar to the size and shape of bore 38. A detailed view of cam 46 is shown in FIG. 6B. attached to the distal end of main body 44 is cam 46 which is generally comprised of a flank 48 having a semicircular cross section connected to a concave engaging face 50 that extends upward from shank 48 to form a lip 52.

Figure 7A:
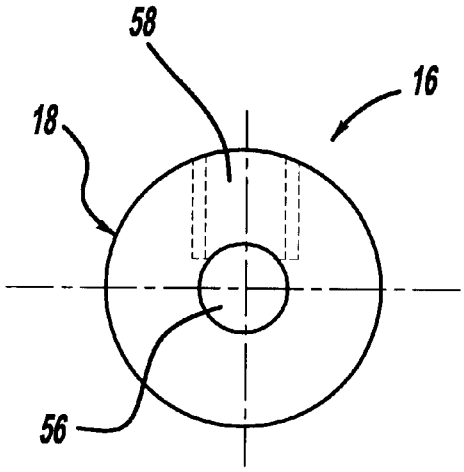
FIG. 7*a* is an end view of a collar in accordance with the principles of the present invention.
Figure 7B:
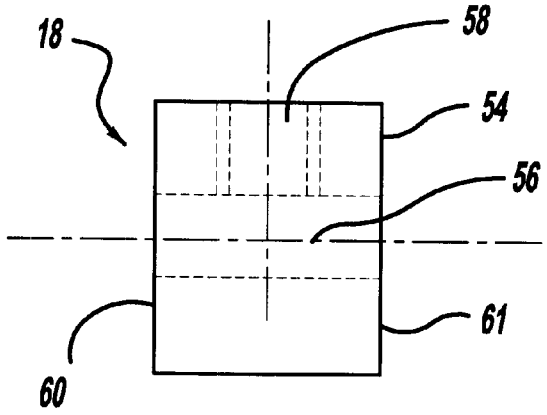
FIG. 7*b* is a side view of the collar of FIG. 7*a;*

As shown in FIGS. 7*a* and 7*b*, collar 18 generally includes a cylindrical body 54 having a bore 56 axially therethrough and a radially extending threaded hole 58, whereby bore 56 receives the key 16 and the notch 42, as best shown in FIG. 3. Threaded hole 58 allows a threaded fastener to secure notch 42 of key 16 with respect to collar 18. In a preferred embodiment, the threaded fastener that is used to secure collar 18 to notch 42 of key 16 is handle 20. Handle 20 generally comprises a body portion 78 and a threaded portion 82 (shown in FIG. 3). Threaded portion 82 is inserted into the threaded bore 58 and body portion 78 is disposed within slot 72 as discussed above. Additionally, handle 20 is attached to the spring element 21 as discussed below to provide a biasing force on collar 18 with respect to the sleeve 14.

Figure 9A:
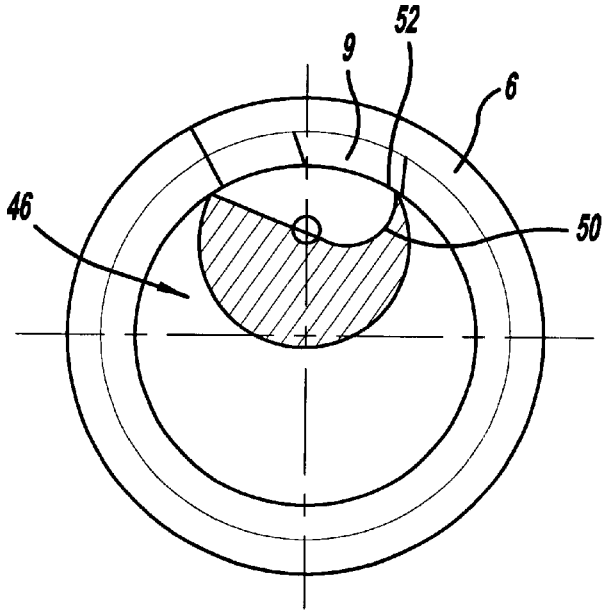
FIG. 9*a* is a sectional view of the key of FIG. 6 in an initial position, disengaged from a helical coil insert.

In a preferred embodiment, spring element 21 is a tension spring that provides a biasing force upon handle 20 to operatively urge key 16 into the initial position A shown in FIG. 9A. Spring element 21 is connected to handle 20 and secured to sleeve 14 through the use of a fastener 59 located in threaded bore 74. The body of spring element 21 is wrapped around the periphery of the sleeve 14 so as to apply the biasing force in a rotational direction. As shown in FIG. 4, bore 74 is disposed adjacent bore 76, whereby bore 76 receives a threaded fastener 61 to selectively attach the head 12 to the sleeve 14.

With reference to the operation of the extraction tool 10, it is understood that modifications may be made to the parts that the present invention is comprised of without departing from the scope of the invention. As stated above, the extraction tool 10, selectively removes helical thread inserts having a removal notch located on the last thread without damaging the parent material that the helical thread insert is disposed in or requiring the use of chamfered or radiused thread ends for removal.

Figure 8:
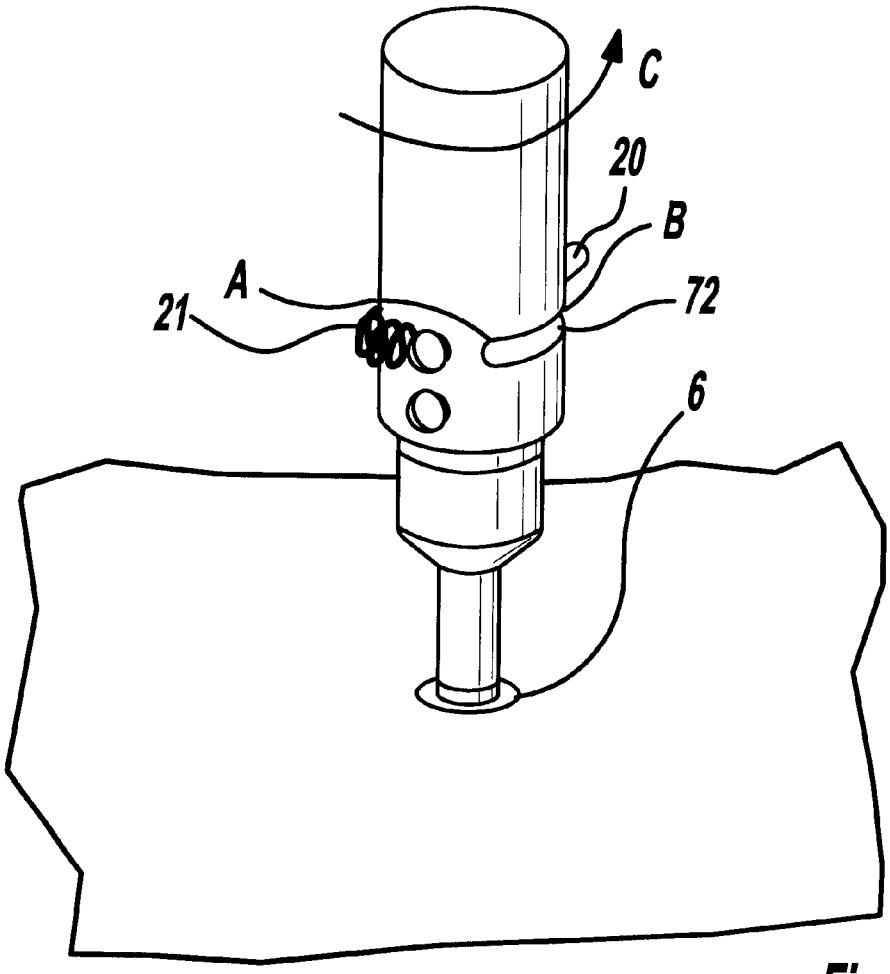
FIG. 8 is a perspective view of the helical thread removal tool of FIG. 3 shown in operative engagement with a helical thread insert.
Figure 10:
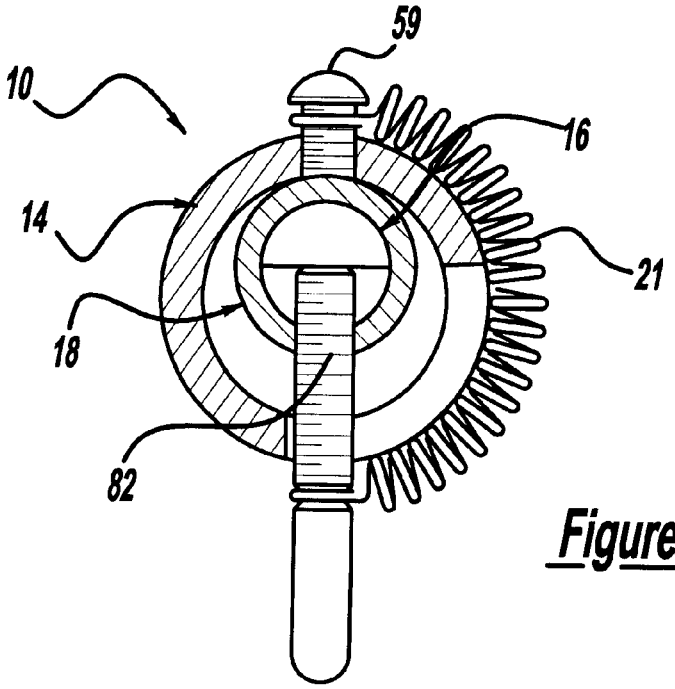
FIG. 10 is a sectional view of the removal tool of FIG. 3 showing the interaction of a spring and a handle in accordance with the principles of the present invention.

FIG. 8 illustrates the configuration required to remove a helical read insert having a removal notch located on the last thread using the present invention. To remove the helical thread insert 6, the pilot journal 32 (not shown) is located within the minor diameter of the helical thread insert 6. To engage the removal notch 9 of helical thread insert 6 handle 20 must be actuated counterclockwise. When the handle is actuated fully, the handle will rotate through the entire distance of guide slot 72 from point A to point B. When the handle 20 is fully actuated to point B, the collar 18 that is connected to the handle 20 has rotated the engaging lip 52 of cam 46 (not shown) into the removal notch 9 of the helical thread insert 6. To remove the helical thread insert 6 handle 20 is rotated counterclockwise concurrently with the sleeve 14, along direction C, until the engagement lip 52 of cam 46 has guided the helical thread insert 6 out of the threaded bore.

Figure 9B:
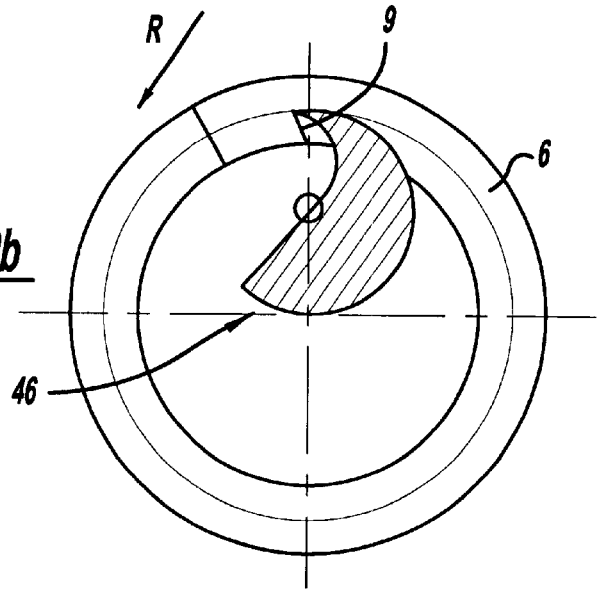
FIG. 9*b* is a sectional view of the key of FIG. 6 engagement with a helical coil insert.
Figure 9C:
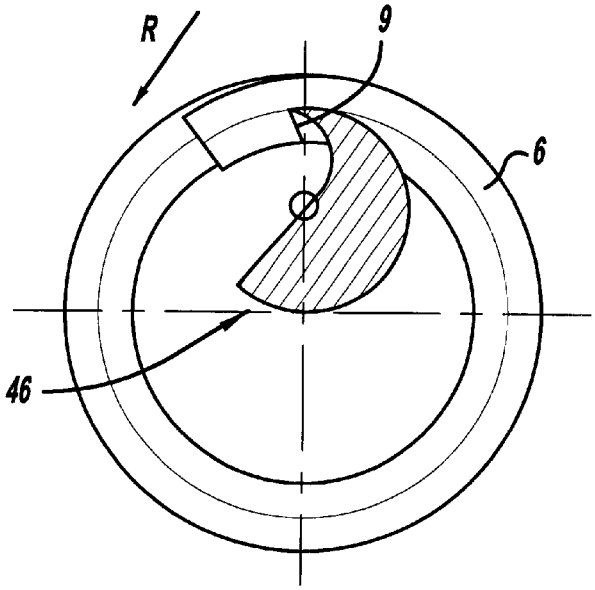
FIG. 9*c* is a sectional view of the key of FIG. 6 in engagement with a helical insert shown in a removal position.

With respect to the actuation of key 16 to engage the removal notch 9 of the thread insert, FIGS. 9A–9C depict the operation threrebetween. In FIG. 9A, key 16 is in a neutral position whereby the extraction tool may be rotated to locate the removal notch. The key is positioned such that engagement lip 52 does not extend out side of the minor diameter of the helical thread insert. Key 16 is actuated in this position when the handle 20 is located in position A.

In FIG. 9B, cam 46 is in an engaged position whereby engagement lip 52 is engaged in the removal notch 9. Cam 46 is positioned such that engagement lip 52 is protruding into removal notch 9. Key end 46 is actuated in this position when the handle 20 is located in position B.

In FIG. 9C the key 16 is in a removal position whereby the engagement lip 52 of the cam 46 is pulling in the end of the helical thread insert 6 along arrow R away from the female threads of the parent material. In this position, the helical thread insert 6 may be removed by actuating sleeve 14 and handle 20 counterclockwise, along direction C concurrently. The force acting on the removal notch 9 pulls the end of the helical thread insert 6 inward and prevents the end of the thread from digging into the parent material.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A tool for removing a helical thread insert having a removal notch formed thereon, the tool comprising:

a body having a bore longitudinally formed therethrough, said bore having a central axis offset from a central axis of said body;

a handle supported by said body, said handle movable between a first position and a second position;

a biasing member biasing said handle into said fist position; and a key rotatably supported in said bore, said key including a first end fixed for rotation with said handle and a second end having a lip formed thereon, said key rotatable between an engaged position and a disengaged position.

2. The tool according to claim 1, wherein said biasing member is a spring.

3. The tool according to claim 1, wherein said handle is received by a collar, said collar being disposed within said body and rotatable therein.

4. The tool according to claim 3, wherein said collar fixedly receives said handle and said first end of said key for rotation therewith.

5. The tool according to claim 1, wherein said body includes a head portion and a sleeve, said head portion being selectively attached to said sleeve.

6. The tool according to claim 1, wherein said lip operably rotates from said bore when is in said second position.

7. The tool according to claim 1, wherein said body includes a collar, said collar fixedly receiving said handle and said first end of said key for rotation therewith.

8. The tool according to claim 1, wherein said body includes a pilot journal for facilitating entry of said body into the helical thread insert.

9. The tool according to claim 8, wherein said pilot journal has an external diameter that is substantially similar to an inner diameter of the helical thread insert.

10. The tool according to claim 1, wherein said lip engages the removal notch of the helical coil insert in said engaged position and is disengaged from said removal notch in said disengaged position.

11. The tool according to claim 1, wherein said key is disengaged from the helical coil insert when said handle is in said first position.

12. The tool according to claim 1, wherein said key engages the helical coil insert when said handle is in said second position.

* * * * *

UNITED STATES PATENT AND TRADEMARK OFFICE

CERTIFICATE OF CORRECTION

PATENT NO. : 6,644,149 B2
DATED : November 11, 2003
INVENTOR(S) : William Giannakakos et al.

It is certified that error appears in the above-identified patent and that said Letters Patent is hereby corrected as shown below:

Title page,
Item [57], ABSTRACT,
Line 9, after "from" insert -- a --.

Column 5,
Line 38, after "body" insert -- including a first portion --; after "therethrough" insert -- and a second portion rotatably supporting a handle --.
Line 40, "body" should be -- first portion and --.
Line 41, delete "a handle supported by said body".

Column 6,
Line 1, "fist" should be -- first --.
Lines 13 and 22, "body" should be -- second portion --.
Lines 17, 25 and 26, "body" should be -- first portion --.
Line 18, after "and" insert -- said second portion includes --.
Line 21, after "said" (second occurrence), insert -- handle --.

Signed and Sealed this

Sixteenth Day of March, 2004

JON W. DUDAS
*Acting Director of the United States Patent and Trademark Office*